US011723396B2

(12) United States Patent
Sutton et al.

(10) Patent No.: US 11,723,396 B2
(45) Date of Patent: Aug. 15, 2023

(54) CARTRIDGE, POUCH AND METHOD OF MANUFACTURE OF POUCH FOR USE WITH APPARATUS FOR HEATING SMOKABLE MATERIAL

(71) Applicant: NICOVENTURES TRADING LIMITED, London (GB)

(72) Inventors: Joseph Sutton, London (GB); Dominic Woodcock, London (GB); Darren Seymour, London (GB); Hitesh Vallabh, London (GB); Neil Litten, London (GB); Harpal Singh, London (GB); David Russell, London (GB); Ahmad Bitar, London (GB)

(73) Assignee: Nicoventures Trading Limited, London (GB)

( * ) Notice: Subject to any disclaimer, the term of this patent is extended or adjusted under 35 U.S.C. 154(b) by 128 days.

(21) Appl. No.: 15/563,078

(22) PCT Filed: Mar. 31, 2016

(86) PCT No.: PCT/EP2016/057060
§ 371 (c)(1),
(2) Date: Sep. 29, 2017

(87) PCT Pub. No.: WO2016/156493
PCT Pub. Date: Oct. 6, 2016

(65) Prior Publication Data

US 2018/0343920 A1 Dec. 6, 2018

(30) Foreign Application Priority Data

Mar. 31, 2015 (GB) ..... 1505595

(51) Int. Cl.
*A24F 40/30* (2020.01)
*A24F 40/20* (2020.01)
(Continued)

(52) U.S. Cl.
CPC ..... *A24C 5/01* (2020.01); *A24D 1/20* (2020.01); *A24F 40/30* (2020.01); *A24F 40/40* (2020.01); *A24F 40/42* (2020.01); *A24F 40/20* (2020.01)

(58) Field of Classification Search
None
See application file for complete search history.

(56) References Cited

U.S. PATENT DOCUMENTS 2,057,353 A 10/1936 Whittemore
2,937,648 A 5/1960 Meyer
(Continued)

FOREIGN PATENT DOCUMENTS

CN 1040496 A 3/1990
CN 2082939 U 8/1991
(Continued)

OTHER PUBLICATIONS

Japanese Office Action, Application No. 2017-551218, dated Oct. 30, 2018, 4 pages.
(Continued)

*Primary Examiner* — Kelly M Gambetta
*Assistant Examiner* — Katherine A Will
(74) *Attorney, Agent, or Firm* — Patterson Thuente P.A.

(57) ABSTRACT

A cartridge is provided for use with an apparatus for heating smokable material. The cartridge has a housing defining a chamber and a pouch containing smokable material. The pouch is located within the chamber. At least part of the pouch is made of porous material for permitting aerosol or volatilized material generated within the pouch to pass out of the pouch from within the pouch. There is also provided a pouch having a first wall and a second wall. The pouch contains smokable material between the first wall and the second wall. A method of manufacturing a pouch is also
(Continued)

disclosed in which the first wall is attached to the second wall with smokable material between the first wall and second wall.

10 Claims, 4 Drawing Sheets

(51) Int. Cl.

| | |
|---|---|
| ***A24C 5/01*** | (2020.01) |
| ***A24F 40/42*** | (2020.01) |
| ***A24F 40/40*** | (2020.01) |
| ***A24D 1/20*** | (2020.01) |

(56) References Cited

U.S. PATENT DOCUMENTS

| | | | | |
|---|---|---|---|---|
| 2,991,788 | A | 7/1961 | Brost | |
| 3,148,996 | A | 9/1964 | Vukasovich | |
| 3,844,199 | A | 10/1974 | Block | |
| 4,219,031 | A | 8/1980 | Rainer | |
| 4,827,950 | A | 5/1989 | Banerjee | |
| 4,846,199 | A | 9/1989 | Rose | |
| 4,924,886 | A | 5/1990 | Litzinger | |
| 5,065,776 | A | 11/1991 | Lawson | |
| 5,115,823 | A | 5/1992 | Keritisis | |
| 5,129,409 | A | 7/1992 | White | |
| 5,144,962 | A | 9/1992 | Counts | |
| 5,369,723 | A | 11/1994 | Counts | |
| 5,415,186 | A | 5/1995 | Casey, III et al. | |
| 5,415,486 | A | 5/1995 | Casey | |
| 5,611,360 | A | 3/1997 | Tang | |
| 5,692,526 | A | 12/1997 | Adams | |
| 5,954,060 | A | 9/1999 | Cardarelli | |
| 6,280,793 | B1 | 8/2001 | Atwell | |
| 6,532,965 | B1 | 3/2003 | Abhulimen | |
| 8,205,622 | B2 | 6/2012 | Pan | |
| 8,975,764 | B1 | 3/2015 | Abehasera | |
| 9,623,205 | B2 | 4/2017 | Buchberger | |
| 9,974,335 | B2 | 5/2018 | Lord | |
| 10,111,466 | B2 | 10/2018 | Lord | |
| 10,278,421 | B2 | 5/2019 | Lord | |
| 2003/0063902 | A1 | 4/2003 | Pedtrotti | |
| 2004/0065749 | A1 | 4/2004 | Kotary | |
| 2006/0131439 | A1 | 6/2006 | Lakatos | |
| 2007/0137667 | A1 | 6/2007 | Zhuang | |
| 2007/0283972 | A1 | 12/2007 | Monsees et al. | |
| 2009/0095311 | A1 | 4/2009 | Han | |
| 2009/0288668 | A1 | 11/2009 | Inagaki | |
| 2009/0293888 | A1 | 12/2009 | Williams | |
| 2009/0302019 | A1 | 12/2009 | Selenski | |
| 2010/0006113 | A1 | 1/2010 | Urtsev | |
| 2010/0024834 | A1 | 2/2010 | Oglesby et al. | |
| 2011/0005535 | A1* | 1/2011 | Xiu | A24F 47/008 131/273 |
| 2011/0094523 | A1 | 4/2011 | Thorens | |
| 2011/0126848 | A1 | 6/2011 | Zuber | |
| 2011/0155153 | A1 | 6/2011 | Thorens | |
| 2011/0168194 | A1 | 7/2011 | Hon | |
| 2011/0209717 | A1 | 9/2011 | Han | |
| 2011/0226236 | A1 | 9/2011 | Buchberger | |
| 2011/0277756 | A1 | 11/2011 | Terry | |
| 2011/0277757 | A1 | 11/2011 | Terry et al. | |
| 2011/0303231 | A1 | 12/2011 | Li | |
| 2012/0111347 | A1 | 5/2012 | Hon | |
| 2012/0179512 | A1 | 7/2012 | O'Keeffe | |
| 2012/0227753 | A1 | 9/2012 | Newton | |
| 2012/0234821 | A1 | 9/2012 | Shimizu | |
| 2012/0255567 | A1 | 10/2012 | Rose et al. | |
| 2012/0279512 | A1 | 11/2012 | Hon | |
| 2012/0285475 | A1 | 11/2012 | Liu | |
| 2013/0037041 | A1* | 2/2013 | Worm | A24F 40/40 131/329 |
| 2013/0056013 | A1 | 3/2013 | Terry | |
| 2013/0192615 | A1 | 8/2013 | Tucker | |
| 2013/0192623 | A1 | 8/2013 | Tucker | |
| 2013/0298905 | A1 | 11/2013 | Levin | |
| 2013/0306085 | A1 | 11/2013 | Sanchez | |
| 2014/0024834 | A1 | 1/2014 | Mergelsberg et al. | |
| 2014/0069444 | A1 | 3/2014 | Cyphert | |
| 2014/0202454 | A1 | 7/2014 | Buchberger | |
| 2014/0299142 | A1 | 10/2014 | Dincer | |
| 2015/0020831 | A1 | 1/2015 | Weigensberg et al. | |
| 2015/0150302 | A1 | 6/2015 | Metrangolo | |
| 2015/0157055 | A1 | 6/2015 | Lord | |
| 2015/0196058 | A1 | 7/2015 | Lord | |
| 2015/0201675 | A1 | 7/2015 | Lord | |
| 2015/0245654 | A1 | 9/2015 | Memari et al. | |
| 2015/0258288 | A1 | 9/2015 | Sullivan | |
| 2015/0333552 | A1 | 11/2015 | Alarcon | |
| 2015/0333561 | A1 | 11/2015 | Alarcon | |
| 2016/0106154 | A1 | 4/2016 | Lord | |
| 2016/0250201 | A1 | 9/2016 | Rose et al. | |
| 2016/0278436 | A1 | 9/2016 | Verleur et al. | |
| 2016/0353804 | A1 | 12/2016 | Lord | |
| 2017/0114965 | A1 | 4/2017 | Maglica et al. | |
| 2017/0173278 | A1 | 6/2017 | Buchberger | |
| 2017/0208865 | A1 | 7/2017 | Nettenstrom et al. | |
| 2017/0251725 | A1 | 9/2017 | Buchberger et al. | |
| 2018/0192705 | A1 | 7/2018 | Lord | |
| 2018/0199618 | A1 | 7/2018 | Fuisz et al. | |
| 2018/0235284 | A1 | 8/2018 | Lord | |

FOREIGN PATENT DOCUMENTS

| | | | |
|---|---|---|---|
| CN | 2249068 | Y | 3/1997 |
| CN | 2719043 | Y | 8/2005 |
| CN | 1925757 | | 3/2007 |
| CN | 201054977 | | 5/2008 |
| CN | 201079011 | | 7/2008 |
| CN | 101277623 | | 10/2008 |
| CN | 101500443 | A | 8/2009 |
| CN | 201379072 | | 1/2010 |
| CN | 201468000 | U | 5/2010 |
| CN | 101795505 | A | 8/2010 |
| CN | 101843368 | | 9/2010 |
| CN | 202085723 | U | 12/2011 |
| CN | 103929988 | A | 7/2014 |
| CN | 103974369 | | 8/2014 |
| CN | 103974639 | A | 8/2014 |
| CN | 104095293 | A | 10/2014 |
| CN | 203943069 | | 11/2014 |
| CN | 204120237 | | 1/2015 |
| CN | 104349687 | A | 2/2015 |
| DE | 822964 | | 11/1951 |
| DE | 29713866 | | 11/1997 |
| DE | 102006004484 | | 8/2007 |
| DE | 102007011120 | | 9/2008 |
| EA | 015651 | B1 | 10/2011 |
| EA | 201100197 | A1 | 3/2012 |
| EP | 0532194 | | 3/1993 |
| EP | 712584 | | 5/1996 |
| EP | 0845220 | A1 | 6/1998 |
| EP | 1283062 | | 2/2003 |
| EP | 0845220 | B1 | 9/2003 |
| EP | 1736065 | A1 | 12/2006 |
| EP | 2022349 | | 2/2009 |
| EP | 1736065 | B1 | 6/2009 |
| EP | 2113178 | | 11/2009 |
| EP | 2119375 | A1 | 11/2009 |
| EP | 2327318 | A1 | 6/2011 |
| EP | 2394520 | | 12/2011 |
| EP | 2404515 | | 1/2012 |
| EP | 2444112 | | 4/2012 |
| EP | 2444411 | A1 | 4/2012 |
| EP | 2939553 | | 11/2015 |
| GB | 2333466 | A | 7/1999 |
| GB | 2496105 | | 5/2013 |
| JP | S5130900 | U | 3/1976 |
| JP | H0339077 | A | 2/1991 |
| JP | H 7502188 | | 3/1995 |
| JP | H0878142 | A | 3/1996 |
| JP | H11507234 | A | 6/1999 |
| JP | 3392138 | | 3/2003 |

(56) References Cited

FOREIGN PATENT DOCUMENTS

| | | | |
|---|---|---|---|
| JP | 2006504431 | A | 2/2006 |
| JP | 2007259864 | A | 10/2007 |
| JP | 2007267749 | | 10/2007 |
| JP | 2009-502136 | | 1/2009 |
| JP | 2009504431 | A | 2/2009 |
| JP | 3153675 | U | 9/2009 |
| JP | 2009-537119 | | 10/2009 |
| JP | 2010520742 | | 6/2010 |
| JP | 3164992 | U | 12/2010 |
| JP | 2011518567 | A | 6/2011 |
| JP | 2012517229 | A | 8/2012 |
| JP | 5130900 | B2 | 1/2013 |
| JP | 2013545473 | A | 12/2013 |
| JP | 2014076065 | A | 5/2014 |
| JP | 2014-525237 | | 9/2014 |
| JP | 2015524257 | A | 8/2015 |
| KR | 20110006928 | A | 1/2011 |
| KR | 20-2011-0006928 | | 7/2011 |
| KR | 101081481 | | 11/2011 |
| RU | 2004116065 | A | 6/2005 |
| RU | 103281 | U1 | 4/2011 |
| RU | 110608 | U1 | 11/2011 |
| RU | 115629 | U1 | 5/2012 |
| SU | 1641182 | A3 | 4/1991 |
| TW | 201225862 | A | 7/2012 |
| WO | WO 9406313 | | 3/1994 |
| WO | WO 9632854 | | 10/1996 |
| WO | WO-9639880 | A1 | 12/1996 |
| WO | WO 98/36651 | | 8/1998 |
| WO | WO 2006048774 | | 5/2006 |
| WO | WO 2007012007 | | 1/2007 |
| WO | WO 007078273 | | 7/2007 |
| WO | WO 2008015441 | | 2/2008 |
| WO | WO 2008/029381 | | 3/2008 |
| WO | WO2009022232 | | 2/2009 |
| WO | WO 2010/045671 | A1 | 4/2010 |
| WO | WO-2010091593 | A1 | 8/2010 |
| WO | WO-2011060788 | A1 | 5/2011 |
| WO | WO-2011079932 | A1 | 7/2011 |
| WO | WO 2011/107737 | A1 | 9/2011 |
| WO | WO 2011/124033 | | 10/2011 |
| WO | WO 2011146372 | | 11/2011 |
| WO | WO 2011/106788 | | 12/2011 |
| WO | WO 2011/160788 | | 12/2011 |
| WO | WO 2012/072762 | | 6/2012 |
| WO | WO-2012156700 | A1 | 11/2012 |
| WO | WO 2013/076098 | | 5/2013 |
| WO | WO 2013/083631 | A1 | 6/2013 |
| WO | WO-2013083634 | A1 | 6/2013 |
| WO | WO 2013/098395 | | 7/2013 |
| WO | WO 2013/116571 | A1 | 8/2013 |
| WO | WO 2013148810 | | 10/2013 |
| WO | WO 2014/061477 | | 4/2014 |
| WO | WO 2014/106093 | | 7/2014 |
| WO | WO 2014104078 | | 7/2014 |
| WO | WO 2014/136872 | | 9/2014 |
| WO | WO 2013178766 | | 12/2015 |

OTHER PUBLICATIONS

Great Britain Search Report, Application No. GB1505595.7, dated Oct. 20, 2015, 4 pages.
Application and File History for U.S. Appl. No. 14/415,552, filed Jan. 16, 2015, Inventor: Christopher Lord.
Application and File History for U.S. Appl. No. 15/914,139, filed Mar. 7, 2018, inventor: Christopher Lord.
Application and File History for U.S. Appl. No. 15/563,065, filed Sep. 29, 2017, Inventors Sutton et al.
Application and File History for U.S. Appl. No. 15/563,086, filed Sep. 29, 2017, Inventor: Sutton.
European Extended Search Report, Application No. 18195423.1, dated Jan. 29, 2019, 11 pages.
Japanese Office Action, Japanese Application No. 2015-522065, dated Jan. 5, 2016, 2 pages.
Canadian Office Action, Application No. 2,878,973, dated Jan. 22, 2016, 6 pages.
International Search Report and Written Opinion dated Dec. 2, 2013, for Application No. PCT/EP2013/064950 filed Jul. 15, 2013.
IPRP mailed Oct. 31, 2014, for Application No. PCT/EP2013/064950 filed Jul. 15, 2013.
Canadian Office Action, Application No. 2,878,959, dated Jan. 18, 2016, 6 pages.
Japanese Office Action, Application No. 2015-522064, dated Jan. 5, 2015, 2 pages.
Translation of Korean Office Action, Application No. 10-2015-7001256, dated Sep. 7, 2016, 11 pages.
Translation of Korean Office Action, Application No. 10-2015-7001257, dated Sep. 8, 2016, 15 pages.
Chinese Office Action, Chinese Application No. 201380038055.5, dated Apr. 18, 2016, 9 pages.
Japanese Office Action for Japanese Application No. 2015-522066 dated Dec. 8, 2015. 2 pages.
Russian Decision to Grant for Russian Application No. 201500878 dated Sep. 9, 2016.
European Search Report for European Application No. 16189742 dated Mar. 17, 2017.
Chinese Office Action for Chinese Application No. 201380038055.5 dated Jul. 11, 2017, 3 pgs.
European Notice of Opposition for European Patent No. EP2871984 dated Jun. 5, 2017, 17 pgs.
Russian Decision to Grant from Russian Application No. 2015100881 dated Apr. 6, 2016.
International Search Report and Written Opinion , Application No. PCT/EP2013/064952, dated Oct. 11, 2013.
International Preliminary Report on Patentability, dated Oct. 27, 2014, Application No. PCT/EP2013/064952.
Korean Office Action, Application No. 10-2017-7034160, dated Jul. 18, 2018, 8 pages.
Japanese Office Action, Application No. 2017-551218, dated Aug. 6, 2019, 16 pages.
Chinese Office Action and Search Report, Application No. 201680020758.9, dated Jul. 23, 2019, 21 pages.
Cambridge Dictionary Sleeve Definition, available at dictionary/Cambridge.org/dictionary/English/sleeve, retrieved on Feb. 9, 2019.
Korean Notice of Trial Decision, IP Trial and Appeal Board, The $10^{th}$ Bureau, Trial Decision, Trial No. 2017 won 5687, dated Aug. 14, 2019, 17 pages.
Chinese Office Action, Application No. 201680020844.X, dated Jul. 2, 2019, 2 pages.
Japanese Office Action, Application No. 2017-551205, dated Oct. 2, 2018, 11 pages.
Great Britain Search Report, Application No. GB1505593.2, dated Sep. 22, 2015, 6 pages.
Japanese Office Action, Application No. 2017-551206, dated Oct. 23, 2018, 4 pages.
GB Search Report, Application No. GB1505597.3, dated Oct. 7, 2015, 3 pages.
International Search Report and Written Opinion, Application No. PCT/EP2016/057064, dated Oct. 19, 2016, 7 pages.
Chinese Office Action, Application No. 201680020842.0, dated Jun. 21, 2019, 25 pages.
Japanese Office Action, Application No. 2017-551218, dated Aug. 6, 2019, 7 pages.
European Search Report, Application No. EP19174777, dated Nov. 11, 2019, 7 pages.
Application and File History for U.S. Appl. No. 14/415,540, filed Jan. 16, 2015, Inventor: Lord, 522 pages.
Application and File History for U.S. Appl. No. 15/563,078, filed Sep. 29, 2017, 413 pages, Inventor: Sutton.
Application and File History for U.S. Appl. No. 15/959,687, filed Apr. 23, 2018, 200 pages, Inventor: Christopher Lord.
CN101843368 Translation, Year 2010, 16 pages.
Decision to Grant dated Oct. 24, 2019 for Russian Application No. 2019118770, 11 pages.
Exam Report from European Application 16189742.6-1006, dated Dec. 19, 2019, 8 pages.

(56) References Cited

OTHER PUBLICATIONS

Extended European Search Report for Application No. 16177005.2, dated Oct. 26, 2016, 7 pages.
International Preliminary Report on Patentability for Application No. PCT/EP2016/057060, dated Jul. 12, 2017, 8 pages.
International Preliminary Report on Patentability for Application No. PCT/EP2016/057097, dated Oct. 12, 2017, 10 pages.
International Search Report and Written Opinion for Application No. PCT/EP2016/057097, dated Sep. 28, 2016, 14 pages.
International Preliminary Report on Patentability for Appl. No. PCT/EP2016/057064, dated Oct. 12, 2017, 10 pages.
International Search Report and Written Opinion for Application No. PCT/EP2013/064950, dated Dec. 2, 2013.
International Search Report for Application No. PCT/EP2016/057060, dated Sep. 28, 2016, 7 pages.
Korean Decision for Refusal for Korean Application No. KR2020110006928 dated Jan. 10, 2019.
KR 101081481 Translation; Kim Hyung Yoon; Nov. 2011, 6 pages.
Office Action and Search Report dated Jun. 24, 2019 for Chinese Application No. CN201680020844.X, 22 pages.
Office Action for Japanese Application No. 2015-522064, dated Dec. 28, 2015, 2 pages.
Office Action for Japanese Application No. 2015-522066, dated Jan. 5, 2016. 2 pages.
Office Action for Japanese Application No. 2018-206299, dated Oct. 6, 2020, 9 pages.
Office Action for Japanese Application No. 2019-124231, dated Oct. 27, 2020, 8 pages.
Office Action dated Aug. 6, 2019 for Japanese Application No. 2017-551218, 16 pages(Including Translation).
Office Action dated May 22, 2020 for Chinese Application No. 201680020844.X, 21 pages.
Office Action dated Sep. 24, 2018 for Russian Application No. 2018118998, 6 pages.
Search Report dated Oct. 7, 2015 for corresponding GB Application No. 15505597.3, 3 pages.
Search Report dated May 17, 2020 for Chinese Application No. 201680020844.X, 4 pages.
Written Opinion for Application No. PCT/EP2016/057060, dated Sep. 28, 2016, 8 pages.
Written Opinion for International Application No. PCT/EP2016/057060, dated Apr. 7, 2017, 6 pages.
Communication pursuant to Article 94(3) EPC for European Application No. 16189742.6, dated Dec. 4, 2020, 9 pages.
Office Action For Chinese Application No. 201811153475.9, dated Apr. 22, 2021, 17 pages.
Office Action for Japanese Application No. 2018-206299, dated Apr. 13, 2021, 7 pages.

* cited by examiner

CARTRIDGE, POUCH AND METHOD OF MANUFACTURE OF POUCH FOR USE WITH APPARATUS FOR HEATING SMOKABLE MATERIAL

CROSS-REFERENCE TO RELATED APPLICATIONS

The present application is a National Phase entry of PCT Application No. PCT/EP2016/057060, filed Mar. 31, 2016, which claims priority from GB Patent Application No. 15055595.7, filed Mar. 31, 2015, each of which is hereby fully incorporated herein by reference.

TECHNICAL FIELD

The present disclosure relates to a cartridge for use with apparatus for heating smokable material to volatilize at least one component of the smokable material, to a pouch for use with apparatus for heating smokable material to volatilize at least one component of the smokable material, and to a method of manufacturing a pouch for use with apparatus for heating smokable material.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

According to a first aspect of the present disclosure, there is provided a cartridge for use with apparatus for heating smokable material to volatilize at least one component of the smokable material, the cartridge comprising: a housing defining a chamber; and a pouch containing smokable material, wherein: the pouch is located within the chamber; at least part of the pouch is made of porous material for permitting aerosol or volatilized material generated within the pouch to pass out of the pouch from within the pouch; the pouch defines part of an exterior surface of the cartridge; the exterior surface of the cartridge comprises a cavity for receiving in use a heating device for heating the smokable material; and the pouch defines at least part of the cavity.

In an exemplary embodiment, the pouch is a first pouch that defines a first part of the cavity; the cartridge comprises a second pouch that contains smokable material and defines a second part of the cavity; and at least part of the second pouch is made of porous material for permitting aerosol or volatilized material generated within the second pouch to pass out of the second pouch from within the second pouch.

In an exemplary embodiment, the first and second pouches define opposite sides of the cavity.

In an exemplary embodiment, the first pouch is unitary with the second pouch.

In an exemplary embodiment, the cavity has a mouth and a longitudinal axis, and a cross-sectional size of the cavity perpendicular to the axis decreases with distance from the mouth over at least a majority of a length of the cavity.

In an exemplary embodiment, the cross-sectional size of the cavity decreases with distance from the mouth over the full length of the cavity.

In an exemplary embodiment, the pouch comprises a first wall made of a first material, and a second wall made of a second material that is a different material to the first material; and the smokable material is arranged between the first wall and the second wall.

In an exemplary embodiment, the second wall is porous for permitting aerosol or volatilized material generated within the pouch to pass out of the pouch from within the pouch, and the first wall is less porous to the aerosol or volatilized material than the second wall.

In an exemplary embodiment, the first wall comprises one or more materials selected from the group consisting of: foil, paper, a polymer, a plastics material, and a combination of foil and paper.

In an exemplary embodiment, the pouch is attached to the housing.

In an exemplary embodiment, the pouch is attached to the housing by an adhesive.

In an exemplary embodiment, the housing comprises a first housing part connected to a second housing part, and a portion of the pouch is trapped between the first housing part and the second housing part so as to attach the pouch to the housing.

In an exemplary embodiment, the housing has an air flow inlet extending therethrough for admitting air into the chamber from an exterior of the housing.

In an exemplary embodiment, the housing has a volatilized material outlet extending therethrough for permitting aerosol or volatilized material generated within the pouch to pass from the chamber out of the housing.

In an exemplary embodiment, the cartridge comprises a mass of aerosol containment material within the chamber.

In an exemplary embodiment, the pouch contains the mass of aerosol containment material.

In an exemplary embodiment, the aerosol containment material comprises one or more materials selected from the group consisting of: wadding, fleece, non-woven material, non-woven fleece, woven material, knitted material, nylon, foam, polystyrene, polyester, polyester filament, polypropylene, and a blend of polyester and polypropylene.

In an exemplary embodiment, at least part of the pouch comprises one or more materials selected from the group consisting of: fleece, viscose, non-woven material, non-woven fleece, woven material, knitted material, nylon, and polyester.

In an exemplary embodiment, the smokable material comprises tobacco.

In an exemplary embodiment, the smokable material comprises an aerosol forming agent.

In an exemplary embodiment, the aerosol forming agent comprises glycerol.

According to a second aspect of the present disclosure, there is provided a pouch for use with apparatus for heating smokable material to volatilize at least one component of the smokable material, the pouch comprising: a first wall made of a first material; and a second wall made of a second material that is a different material to the first material; wherein the pouch contains smokable material between the first wall and the second wall.

In an exemplary embodiment, the second wall is porous for permitting aerosol or volatilized material generated within the pouch to pass out of the pouch from within the pouch, and the first wall is less porous to the aerosol or volatilized material than the second wall.

In an exemplary embodiment, the second material comprises one or more materials selected from the group consisting of: fleece, viscose, non-woven material, non-woven fleece, woven material, knitted material, nylon, and polyester.

In an exemplary embodiment, the first wall comprises one or more materials selected from the group consisting of: foil, paper, a polymer, a plastics material, and a combination of foil and paper.

In an exemplary embodiment, the smokable material comprises tobacco.

In an exemplary embodiment, the smokable material comprises an aerosol forming agent.

In an exemplary embodiment, the aerosol forming agent comprises glycerol.

According to a third aspect of the present disclosure, there is provided a method of manufacturing a pouch for use with apparatus for heating smokable material to volatilize at least one component of the smokable material, the method comprising: providing a first wall made of a first material, and a second wall made of a second material that is a different material to the first material; and attaching the first wall to the second wall with the smokable material between the first wall and the second wall.

In an exemplary embodiment, the method comprises depositing the smokable material onto the second wall, and then attaching the first wall to the second wall with the smokable material between the first wall and the second wall.

In an exemplary embodiment, the second wall defines a pocket, and the depositing comprises depositing the smokable material into the pocket.

In an exemplary embodiment, the depositing comprises depositing the smokable material and aerosol containment material into the pocket.

In an exemplary embodiment, the second wall is porous for permitting aerosol or volatilized material generated within the pouch to pass out of the pouch from within the pouch, and the first wall is less porous to the aerosol or volatilized material than the second wall.

In an exemplary embodiment, the second material comprises one or more materials selected from the group consisting of: fleece, viscose, non-woven material, non-woven fleece, woven material, knitted material, nylon, and polyester.

In an exemplary embodiment, the first wall comprises one or more materials selected from the group consisting of: foil, paper, a polymer, a plastics material, and a combination of foil and paper.

In an exemplary embodiment, the smokable material comprises tobacco.

BRIEF DESCRIPTION OF THE DRAWINGS

Embodiments of the disclosure will now be described, by way of example only, with reference to the accompanying drawings, in which.

DETAILED DESCRIPTION

As used herein, the term "smokable material" includes materials that provide volatilized components upon heating, typically in the form of an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, gel or agglomerates. "Smokable material" also may include other, non-tobacco, products, which, depending on the product, may or may not contain nicotine.

Figure 1:
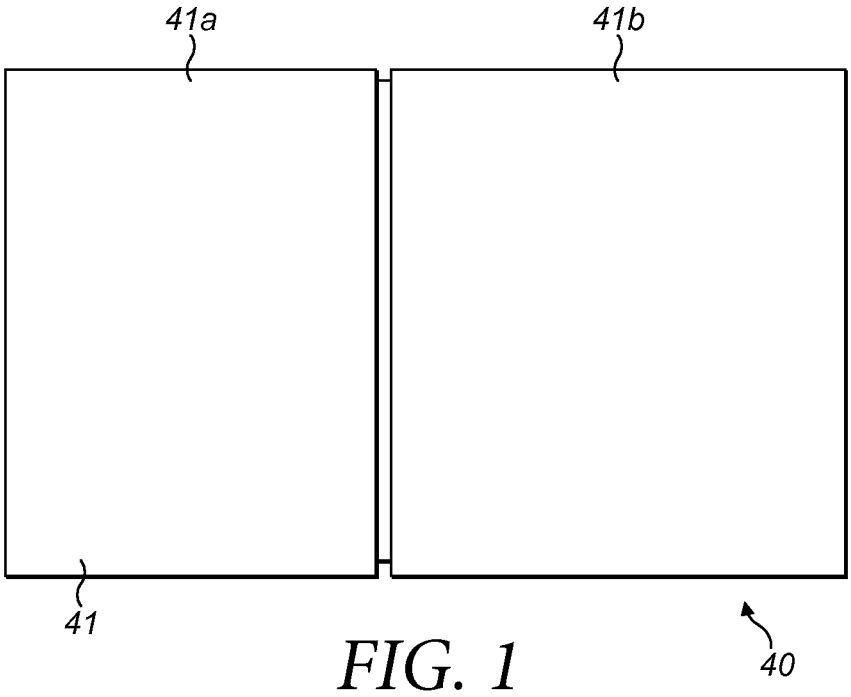
FIG. 1 shows a schematic top view of an example of a cartridge for use with apparatus for heating smokable material to volatilize at least one component of the smokable material.
Figure 2:
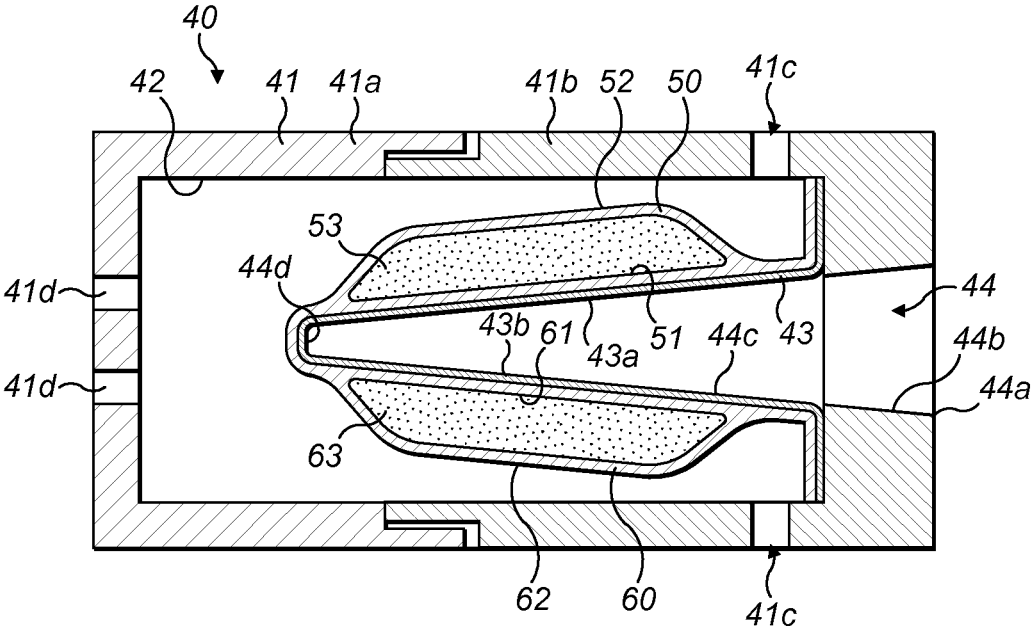
FIG. 2 shows a schematic cross-sectional view of the cartridge of FIG. 1.

Referring to FIGS. 1 and 2, there are shown a schematic top view and a schematic cross-sectional view of an example of a cartridge 40 according to an embodiment of the invention.

The cartridge 40 of this embodiment comprises a housing 41 defining a chamber 42. In this embodiment, the housing 41 comprises a first housing part 41*a* and a second housing part 41*b* that is non-unitary with the first housing part 41*a*. The first housing part 41*a* is attached to the second housing part 41*b*, such as by a snap-fit connection, adhesive, or the like. In other embodiments, the housing 41 may take a different form. For example, in some embodiments the first and second housing parts 41*a*, 41*b* may be unitary, such as following welding, e.g. sonic welding. In some embodiments, the first and second housing parts 41*a*, 41*b* may be unitary and connected by a living hinge. The first and second housing parts 41*a*, 41*b* may be made of any suitable material, such as a plastics material.

The cartridge 40 further comprises a first pouch 50 and a second pouch 60. In this embodiment, the first pouch 50 is unitary with the second pouch 60, and together the first and second pouches are referred to herein as an assembly of the pouches 50, 60. However, in other embodiments, the first pouch 50 may be non-unitary with the second pouch 60. Each of the pouches 50, 60 contains smokable material 53, 63. Each of the pouches 50, 60 comprises a first wall 51, 61 and a second wall 52, 62, and in each pouch 50, 60 the smokable material 53, 63 is arranged between the first wall 51, 61 and the second wall 52, 62. In this embodiment, the first wall 51, 61 of each of the pouches 50, 60 is made of a first material, and the second wall 52, 62 of each of the pouches 50, 60 is made of a second material that is a different material to the first material. However, in other embodiments, the first and second walls 51, 52, 61, 62 may be made of the same material, such as the second material.

In this embodiment, part of each of the pouches 50, 60 is made of porous material for permitting aerosol or volatilized material generated within the pouch 50, 60 on heating the smokable material 53, 63 to pass out of the pouch 50, 60 from within the pouch 50, 60. In this embodiment, in each pouch 50, 60, the second wall 52, 62 is made of such a porous material, and the first wall 51, 61 is made of a material that is less porous to the aerosol or volatilized material than the porous material. Therefore, in this embodiment, in each pouch 50, 60, the second wall 52, 62 is porous for permitting aerosol or volatilized material generated within the pouch 50, 60 to pass out of the pouch 50, 60, and the first wall 51, 61 is less porous to the aerosol or volatilized material than the second wall 52, 62. However, in other embodiments, each of the first and second walls 51, 52, 61, 62 of the pouches 50, 60 may be made of porous material for permitting the aerosol or volatilized material to pass out of the pouch 50, 60. The porous material may, for example, comprise one or more materials selected from the group consisting of: fleece, viscose, non-woven material, non-woven fleece, woven material, knitted material, nylon, and polyester. The first material may comprise one or more of a foil, a metal foil, a non-metal foil, paper, a polymer, a plastics material, or a combination of foil and paper, such as paper overlaid with foil, or the like.

Each of the pouches 50, 60 is located within the chamber 42. In this embodiment, each of the pouches 50, 60 is attached to the housing 41. More specifically, in this embodiment, each of the pouches 50, 60 is attached to an inner surface of the second housing part 41*b*, such as by an adhesive or by pinning. In one embodiment, the method of manufacturing the cartridge 40 comprises attaching the pouches 50, 60 to the inner surface of the second housing part 41*b*, and then attaching the first housing part 41*a* to the second housing part 41*b* to surround the pouches 50, 60 within the housing 41. However, in other embodiments, one or each of the pouches 50, 60 may be attached to the housing 41 in a different manner. For example, in some embodiments, one or each of the pouches 50, 60 may have a portion that is trapped between the first housing part 41*a* and the second housing part 41*b* so as to attach the or each pouch 50, 60 to the housing 41. In some embodiments, one or both of the pouches 50, 60 may not be attached to the housing 41.

In this embodiment, the assembly of the pouches 50, 60 comprises a carrier 43. The first walls 51, 61 of the first and second pouches 50, 60 comprise respective first and second portions 43*a*, 43*b* of the carrier 43. The carrier 43 may act to support the rest of the first and second pouches 50, 60. In some embodiments, the carrier 43 is more rigid or robust than each of the second walls 52, 62 of the first and second pouches 50, 60. The carrier 43 is thermally-conductive and is for conducting heat from the cavity 44 to the smokable material 53, 63 in the pouches 50, 60. In this embodiment, the carrier 43 comprises a metal foil, such as aluminum foil, but in other embodiments the carrier 43 may comprise one or more materials selected from the group consisting of: foil, paper, a polymer, a plastics material, and a combination of foil and paper. In some embodiments, the carrier 43 may be omitted, or may not be part of the assembly of the pouches 50, 60 as such.

An exterior surface of the cartridge 40 comprises a cavity 44 for receiving a heating device for heating the smokable material 53, 63. In an embodiment, the cavity 44 in use receives a heater of an apparatus that has a heater which is engaged in use by the cartridge. The "exterior surface" may be a surface that envelops the rest of the cartridge 40, or that delineates the cartridge 40. The exterior surface of the cartridge 40 comprises a portion that is recessed to provide the cavity 44. In this embodiment, each of the pouches 50, 60 defines part of the cavity 44. That is, the first pouch 50 defines a first part of the cavity 44, and the second pouch 60 defines a second part of the cavity 44. Accordingly, in this embodiment, each of the pouches 50, 60 defines part of the exterior surface of the cartridge 40. In this embodiment, the first walls 51, 61 of the pouches 50, 60 define the first and second parts, respectively, of the cavity 44. More specifically, the first and second portions 43*a*, 43*b* of the carrier 43 define the first and second parts, respectively, of the cavity 44. In this embodiment, the first and second parts of the cavity 44 are opposite sides of the cavity 44, so that the cavity 44 is located between the first and second pouches 50, 60. In another embodiment that is a variant of this embodiment, the second pouch 60 may be omitted. In such a variant, the first wall 51 of the pouch may define part of the cavity 44, and the rest of the cavity 44 may be defined by one or more further elements.

In this embodiment, the cavity 44 has a mouth 44*a*, first and second trunk sections 44*b*, 44*c*, and a closed end 44*d*. The first trunk section 44*b* connects the mouth 44*a* to the second trunk section 44*c*, and the second trunk section 44*c* connects the first trunk section 44*b* to the closed end 44*d*. The cavity 44 has a length that is measured from the mouth 44*a* to the closed end 44*d*, and that extends along an axis of the cavity 44. In this embodiment, the second housing part 41*b* defines the mouth 44*a* and a first trunk section 44*b*, whereas the pouches 50, 60 define the second trunk section 44*c* and the closed end 44*d*.

In this embodiment, the pouches 50, 60 and the second housing part 41*b* are shaped and relatively positioned so that the cavity 44 is a wedge-shaped cavity 44. In this embodiment, the wedge-shaped cavity 44 is symmetrical or rotationally-symmetrical. In other embodiments, it may instead be asymmetrical. A cross-sectional size (for example, a width, a height, a diameter, a dimension, or an area) of the cavity 44 decreases with distance from the mouth 44*a* over the full length of the cavity 44 from the mouth 44*a* to the closed end 44*d*. In this embodiment, the cross-sectional size of the cavity 44 decreases at a linear rate with distance from the mouth 44*a*. In other embodiments, the rate may be non-linear. For example, in some embodiments, the cross-sectional size (for example, a width, a height, a diameter, a dimension, or an area) of the first trunk section 44*b* may decrease at a first rate with distance from the mouth 44*a*, whereas the cross-sectional size (for example, a width, a height, a diameter, a dimension, or an area) of the second trunk section 44*c* may decrease at a second, different rate with distance from the first trunk section 44*b*. The second rate may be more than the first rate.

The tapered profile may help a user to guide the heating device into the cavity 44. By providing that the cross-sectional size of the cavity 44 decreases with distance from the mouth 44*a* over the full length of the cavity 44, the heating device may be introducible into the cavity 44 in a direction non-parallel to the first walls 51, 61 of the pouches 50, 60. Therefore, the heating device may be a close fit with the first walls 51, 61 of the pouches 50, 60 in use. This provides good conduction of heat from the heating device to the pouches 50, 60 and the smokable material 53, 63, yet rubbing of the heating device against the pouches 50, 60 during such insertion of the heating device may be minimized or avoided. This can help reduce or avoid the pouches 50, 60 being torn or otherwise damaged by insertion of the heating device, and reduces wear of the heating device.

In some other embodiments, the pouches 50, 60 and the second housing part 41*b* may be shaped and relatively positioned so that the cavity 44 is other than wedge-shaped, such as dome-shaped. Such a dome-shaped cavity may be symmetrical or rotationally-symmetrical, or asymmetrical.

In some embodiments, the cavity 44 may be of constant, or substantially constant, cross-sectional shape and size (for example, a width, a height, a diameter, a dimension, or an area) over a majority, or only a majority, of the length of the cavity 44.

In this embodiment, air flow inlets 41*c* extend through the second housing part 41*b* for admitting air into the chamber 42 from an exterior of the housing 41. In other embodiments, there may be only one air flow inlet 41*c* in place of the plurality of air flow inlets 41*c*, or the air flow inlet(s) 41*c* may take some other form and/or may extend through a different part of the housing 41.

In this embodiment, apertures 41*d* extend through the first housing part 41*a*. Each of the apertures 41*d* is a volatilized material outlet 41*d* for permitting volatilized material generated within the pouches 50, 60 by heating of the smokable material 53, 63 to pass from the chamber 42 out of the housing 41. In other embodiments, there may be only one aperture 41*d* in place of the plurality of apertures 41*d*, or the volatilized material outlet(s) 41*d* may take some other form and/or may extend through a different part of the housing 41.

In some embodiments, one or each of the pouches 50, 60 contains a mass of aerosol containment material. The mass of aerosol containment material is a porous material for the containment of aerosol generated in the pouches 50, 60 in use by heating the smokable material 53, 63. In some embodiments, in each of the pouches 50, 60 the mass of aerosol containment material may be located between the smokable material 53, 63 and the second wall 52, 62 of the pouch 50, 60. In some embodiments, the smokable material 53, 63 is in contact with the mass of aerosol containment material. In other embodiments, one or each of the pouches 50, 60 may itself comprise a mass of aerosol containment material. For example, in some embodiments, the second wall 52, 62 of one or each of the pouches 50, 60 may comprise a mass of aerosol containment material. The aerosol containment material may comprise wadding or fleece, such as with a density of about 100 gsm or about 120 gsm. Other aerosol containment materials that may be used in other embodiments are discussed below. In some embodiments, the mass of aerosol containment material may be omitted from the cartridge 40.

The cartridge 40 shown in FIGS. 1 and 2 is usable with an apparatus (not shown) for heating the smokable material 53, 63 to volatilize at least one component of the smokable material. In some embodiments, the apparatus is for heating the smokable material 53, 63 of the cartridge 40 to volatilize at least one component of the smokable material 53, 63 without combusting, or burning, the smokable material.

In some respective embodiments, the apparatus comprises a heating device for contacting, or for coming into close proximity to, the pouches 50, 60 of the cartridge 40. In some embodiments, the heating device has a surface profile that matches, or closely matches, a surface profile of the first walls 51, 61 of the pouches 50, 60, or matches, or closely matches, a surface profile of the cavity 44. This helps provide good conduction of heat from the heating device to the carrier 43, and the smokable material 53, 63 contained in the pouches 50, 60.

In some embodiments, the apparatus comprises a controller for controlling heating of the heating device so as to cause heating of the smokable material 53, 63 to volatilize the at least one component of the smokable material 53, 63 without combusting the smokable material 53, 63. In some embodiments, the controller is for controlling the supply of power from a power source to the heating device. In some embodiments, the controller is configured to ensure that the temperature of the heating device remains within a temperature range of about 150 degrees Celsius to about 300 degrees Celsius, or about 170 degrees Celsius to about 220 degrees Celsius. In some embodiments, within this temperature range, the smokable material 53, 63 of the cartridge 40 is heated sufficiently to volatilize at least one component of the smokable material 53, 63 without combusting the smokable material 53, 63. In other embodiments, the temperature range of heating may be other than this range. In some embodiments, following the volatilization of the at least one component of the smokable material 53, 63, an aerosol for inhalation by a user is formed. For example, a user drawing on an outlet of the apparatus may draw air through the apparatus, which cools the volatilized component(s) of the smokable material 53, 63 so that they condense to form the aerosol.

In some embodiments, the heating device of the apparatus may comprise a first heater and a second heater. When the heating device is in the cavity 44 of the cartridge 40, the first heater may be closer to the smokable material 53 contained in the first pouch 50 than to the smokable material 63 contained in the second pouch 60, and the second heater may be closer to the smokable material contained in the second pouch 60 than to the smokable material 53 contained in the first pouch 50. Therefore, in use, the first heater may be predominantly for heating the smokable material 53 contained in the first pouch 50, and the second heater may be predominantly for heating the smokable material contained in the second pouch 60. The controller of the apparatus may be for controlling the supply of power from the power source to the first heater independently of the supply of power from the power source to the second heater. The manner in which the controller causes the first and second heaters to be heated may be selectable by a user. Thus, in some embodiments, a user may be able to select which of the first and second heaters is to be heated, and thus which of pouches is predominantly to be heated. In embodiments in which the first and second pouches 50, 60 contain different forms or compositions of smokable material 53, 63, a user may thus be able to select or configure the type of aerosol they wish to generate, and thus the experience they wish to have on inhaling the aerosol.

Referring to FIGS. 3-6, a method for manufacturing the assembly of the first and second pouches 50, 60 of the cartridge 40 shown in FIGS. 1 and 2 will be described. In summary, the method comprises providing a first body 151 made of a first material and a second body 152 made of a second material that is a different material to the first material; depositing the smokable material 53, 63 onto the second body 152 in discrete quantities; and then attaching the first body 151 to the second body 152 with the discrete quantities of smokable material 53, 63 between the first body 151 and the second body 152, so as to form pouches 50, 60 containing the respective discrete quantities of smokable material 53, 63 between the first and second bodies 151, 152. In the manufactured assembly, the first wall 51, 61 of each of the pouches 50, 60 is provided by part of the first body 151, and the second wall 52, 62 of each of the pouches 50, 60 is provided by part of the second body 152.

Figure 3:
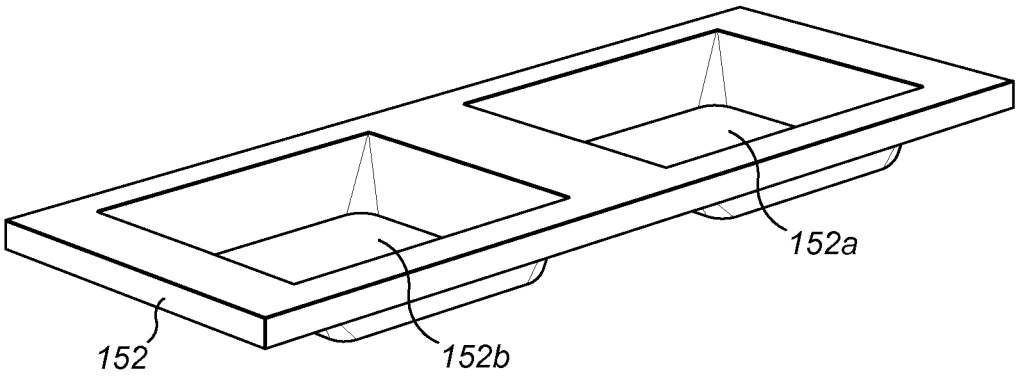
FIG. 3 shows a schematic perspective view of a second body of a second material used in a method of manufacturing an assembly of pouches.
Figure 4:
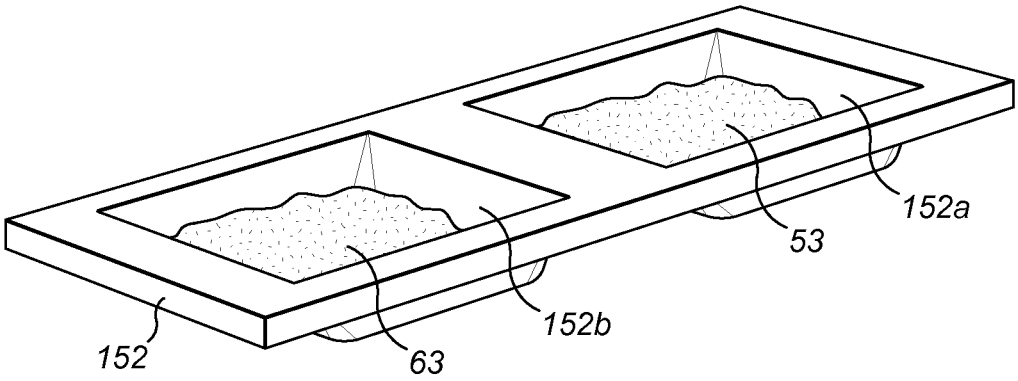
FIG. 4 shows a schematic perspective view of the second body of FIG. 3 and smokable material deposited in pockets defined by the second body.
Figure 5:
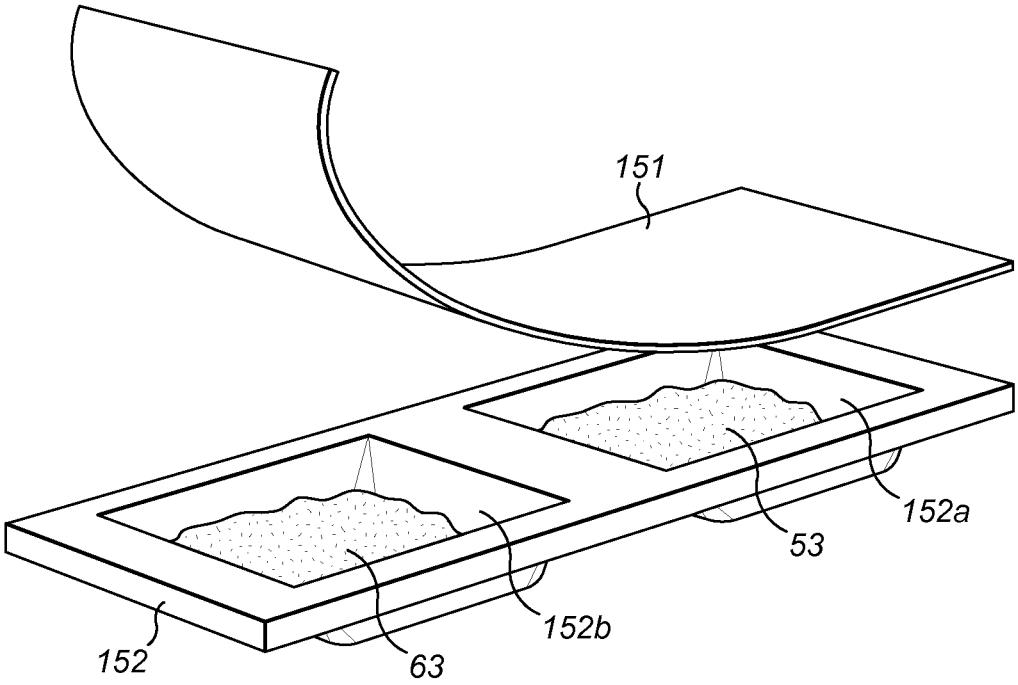
FIG. 5 shows a schematic perspective view of a first body of a first material being attached to the second body of FIG. 4 with the smokable material between the first body and the second body.
Figure 6:
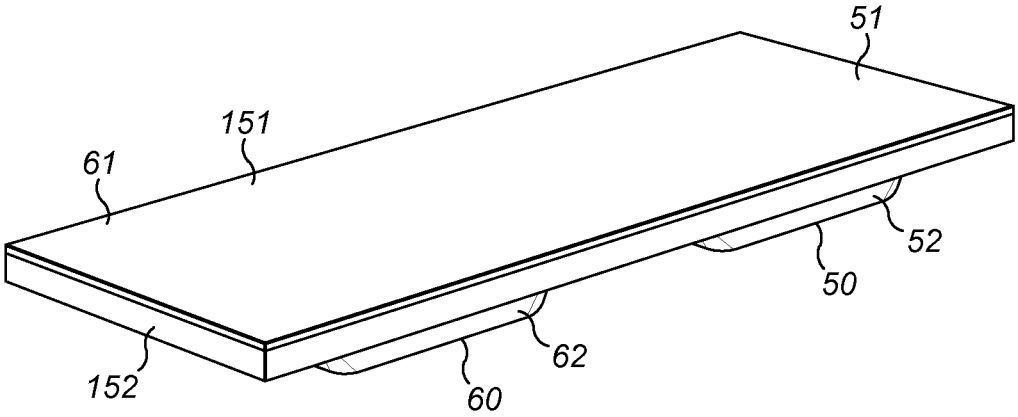
FIG. 6 shows a schematic perspective view of the manufactured assembly of pouches.

As shown in FIG. 3, in this embodiment the second body 152 defines a plurality of pockets 152*a*, 152*b* for receiving the discrete quantities of smokable material 53, 63. In this embodiment, the smokable material 53, 63 is deposited in the pockets 152*a*, 152*b*, as shown in FIG. 4. Then, the first body 151 is attached to the second body 152 with the smokable material 53, 63 in the pockets 152*a*, 152*b*, as shown in FIG. 5. After the first body 151 has been so attached to the second body 152, the smokable material 53, 63 is contained between the first and second bodies 151, 152 and in the pouches 50, 60 of the assembly so formed, as shown in FIG. 6. In some embodiments, the smokable material 53, 63 and aerosol containment material, such as any of the aerosol containment materials discussed herein, may be deposited in the pockets 152*a*, 152*b*. In some embodiments, the second body 152 may not define such pockets 152*a*, 152*b*, and the smokable material 53, 63 may be deposited on the second body 152 in discrete quantities. In some embodiments, the smokable material 53, 63 may be provided between the first and second bodies 151, 152 in some other manner, such as by being deposited on the first body 151 before the second body 152 is attached to the first body 151.

In some embodiments of the method, after the first body 151 has been attached to the second body 152 to contain the smokable material 53, 63 between the first and second bodies 151, 152, the method may comprise cutting through the first and second bodies 151, 152 between adjacent pouches 50, 60. The spacing of the cuts may, for example, be to define both the first and second pouches 50, 60 between successive cuts, or to define only one pouch 50, 60 between successive cuts. In another embodiment of the method, one of the pouches 50, 60 may be manufactured in isolation. That is, the pouch 50, 60 may never be unitary with another pouch 50, 60.

According to the embodiment of the method described above with reference to FIGS. 3-6, a pouch 50, 60 is manufactured by providing a first wall 51, 61 made of a first material and a second wall 52, 62 made of a second material that is a different material to the first material; and attaching the first wall 51, 61 to the second wall 52, 62 with the smokable material 53, 63 between the first wall 51, 61 and the second wall 52, 62. In this embodiment, the smokable material 53, 63 is deposited into a pocket 152*a*, 152*b* defined by the second wall 52, 62, and then the first wall 51, 61 is attached to the second wall 52, 62 with the smokable material between the first wall 51, 61 and the second wall 52, 62. The other embodiments of the method described above also result in the manufacture of a pouch 50, 60.

In each of the above-described methods, the second material is a porous material for permitting aerosol or volatilized material generated within the manufactured pouch 50, 60 to pass out of the pouch 50, 60 from within the pouch 50, 60, and the first material is a material that is less porous to the aerosol or volatilized material than the porous material. The second material may comprise one or more materials selected from the group consisting of: fleece, viscose, non-woven material, non-woven fleece, woven material, knitted material, nylon, and polyester. The first material may comprise one or more materials selected from the group consisting of: foil, paper, a polymer, a plastics material, and a combination of foil and paper. In other embodiments, the first body 151 or first wall 51, 61 may be made of the second material.

In each of the above described embodiments, the smokable material 53, 63 comprises tobacco. However, in respective variations to each of these embodiments, the smokable material 53, 63 may consist of tobacco, may consist substantially entirely of tobacco, may comprise tobacco and smokable material other than tobacco, may comprise smokable material other than tobacco, or may be free of tobacco. In some embodiments, the smokable material 53, 63 may include an aerosol forming agent, such as glycerol.

In the above-described embodiments in which aerosol containment material is present in the cartridge 40, the aerosol containment material comprises wadding or fleece with a density of about 100 gsm or about 120 gsm. In other embodiments, the density of the aerosol containment material may be different. However, if the density is too high, the aerosol containment material may act as a filter and attenuate generated aerosol. Alternatively, if the density is too low, the aerosol containment material may not provide effective aerosol containment. An appropriate density, particularly when the aerosol containment material comprises wadding or fleece, may be between about 60 and about 140 gsm, or between about 80 and about 120 gsm. In some embodiments, the aerosol containment material may have a thickness within a range of 1 mm to 2 mm.

In still further embodiments, the aerosol containment material may comprise one or more materials selected from the group consisting of: wadding, fleece, non-woven material, non-woven fleece, woven material, knitted material, nylon, foam, polystyrene, polyester, polyester filament, polypropylene, and a blend of polyester and polypropylene. When a material other than wadding or fleece is used, the material would have a density chosen to have similar thermal properties to wadding or fleece having a density of from about 80 to about 120 gsm. In each of the above-described embodiments of the cartridge or pouch, the aerosol containment material is free of smokable material. However, this need not always be the case.

In some embodiments, the mass of aerosol containment material is heat resistant at least over the expected range of temperatures of the heating device 20 of the apparatus that will arise in operation, such as for example 150 to 300 degrees Celsius or 170 to 220 degrees Celsius as discussed above, and will not degrade when subjected to such operation temperatures.

In some embodiments, the aerosol containment material helps to ensure that volatilized material generated in the pouch in use does not condense on an inner surface of the housing 41 of the cartridge 40. In some embodiments, the provision of the mass of aerosol containment material helps to increase the surface area on which aerosol generated in the pouch in use may form. In some embodiments, such a mass of aerosol containment material helps to increase the amount of visible aerosol generated in, or emitted from, the pouch in use, and thus may enhance the consumer experience.

As discussed above, in some embodiments the aerosol containment material may be omitted.

In each of the above embodiments, the cartridge 40 is a consumable cartridge. Once all, or substantially all, of the volatile component(s) of the smokable material in the cartridge 40 has/have been spent, the user may remove the cartridge from the apparatus and dispose of the cartridge. The user may subsequently re-use the apparatus with another of the cartridges 40. However, in other respective embodiments, the cartridge 40 may be non-consumable, and the combination of the apparatus and the cartridge 40 may be disposed of together once the volatile component(s) of the smokable material has/have been spent.

In some embodiments, the apparatus discussed above may be sold, supplied or otherwise provided separately from the cartridge 40 with which the apparatus is usable. However, in other embodiments, the apparatus and one or more of the cartridges 40 may be provided together as a kit.

Figure 7:
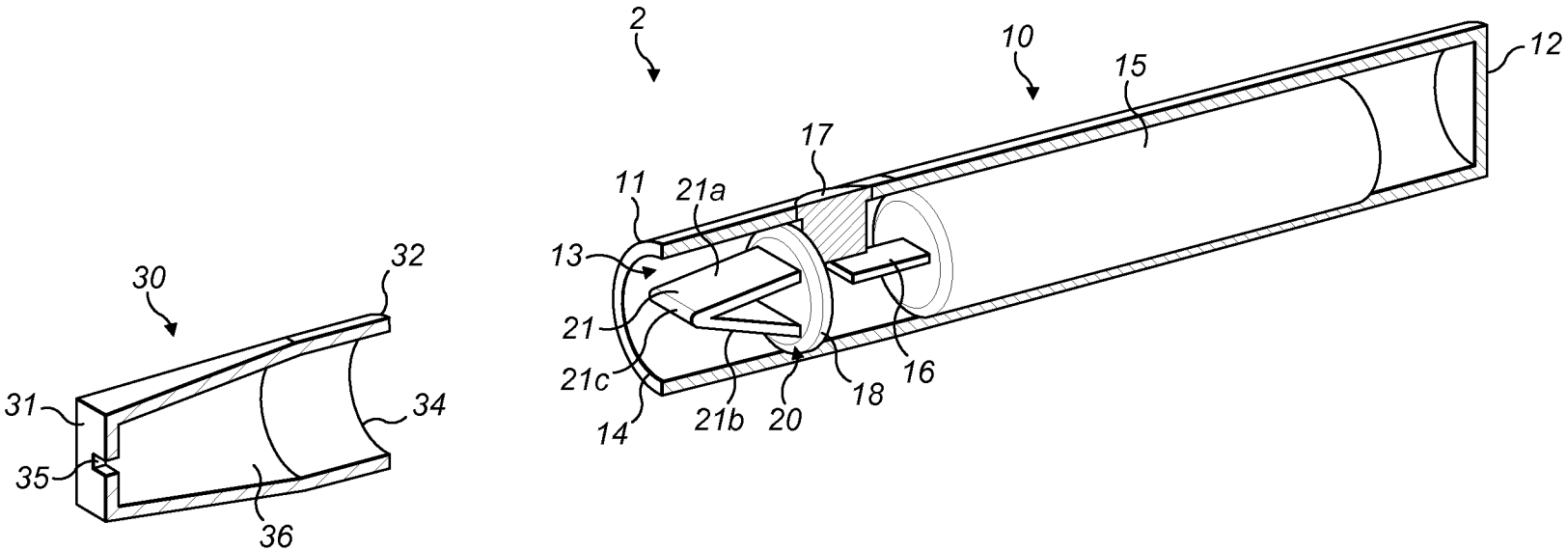
FIG. 7 shows a partially cut-away perspective view of an example of an apparatus for heating smokable material to volatilize at least one component of the smokable material.

Referring to FIG. 7, there is shown a partially cut-away perspective view of an example of an apparatus 2 for heating smokable material to volatilize at least one component of the smokable material. The apparatus 2 is particularly suitable for use with a cartridge 40 as described above. The apparatus 2 has a body 10 which is generally tubular and elongate, has first and second opposite longitudinal ends 11, 12, and defines an interface for co-operating with the cartridge 40. In this embodiment, the interface comprises a recess 13 for receiving the cartridge 40. In other embodiments, the interface can take a different form, such as a shelf, a surface, or a projection, and optionally requires mechanical mating with the cartridge 40 in order to cooperate with the cartridge 40. The first longitudinal end 11 of the body 10 defines an opening 14 into the recess 13 at a first end of the recess 13. The opening 14 is shaped and sized so that the cartridge 40 is movable through the opening 14 to allow a user to insert the cartridge 40 into the recess 13 and/or to remove the cartridge 40 from the recess 13.

The apparatus 2 has a heating device 20. In the example shown the heating device 20 has a wedge-shape heater 21 which projects into the recess 13. The apparatus 2 shown also has electrical components such as an electrical power source 15 (such as a rechargeable or non-rechargeable battery), a controller 16 and an actuator 17 for enabling user activation of the heater 21. The wedge-shape heater 21 can be inserted into the cavity 44 of the cartridge 40 to heat the carrier 43. In an embodiment, the wedge-shape heater 21 fits snugly in the cavity 44 for efficient heat transfer to the carrier 43 and the smokable material 53, 63.

In this embodiment, the heater 21 is a folded heater 21 comprising a first heater portion 21*a* and a second heater portion 21*b*. The heater 21 has a fold 21*c* therein, and the first heater portion 21*a* is connected to the second heater portion 21*b* at the fold 21*c*. The fold 21*c* forms a distal end of the heater 21, which distal end is distal from the retainer 18. The first heater portion 21*a* defines an upper surface of the heater 21, and the second heater portion 21*b* defines a lower surface of the heater 21. In this embodiment, the first and second heater portions 21*a*, 21*b* lie substantially in respective first and second planes, and the first and second planes meet at an acute angle.

In this embodiment, the apparatus 2 has a mouthpiece 30 which is generally tubular and elongate and has first and second opposite longitudinal ends 31, 32. The mouthpiece 30 comprises an inlet 34 at the second longitudinal end 32 of the mouthpiece 30, an outlet 35 at the first longitudinal end 31 of the mouthpiece 30, and a channel 36 fluidly connecting the inlet 34 with the outlet 35. The second longitudinal end 32 of the mouthpiece 30 comprises a connector (not shown) that is releasably engageable with a connector (not shown) of the first longitudinal end 11 of the body 10, so as to connect the mouthpiece 30 to the body 10. In other embodiments, the mouthpiece 30 and the body 10 may be permanently connected, such as through a hinge or flexible member. When the apparatus 2 is in use, the first longitudinal end 31 of the mouthpiece 30 forms a first longitudinal end of the apparatus 2, and the second longitudinal end 12 of the body 10 forms a second longitudinal end of the apparatus 2.

In order to address various issues and advance the art, the entirety of this disclosure shows by way of illustration and example various embodiments in which the claimed invention may be practiced and which provide for a superior cartridge and/or pouch for use with apparatus for heating smokable material to volatilize at least one component of the smokable material. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A cartridge for use with apparatus for heating smokable material to volatilize at least one component of the smokable material, the cartridge comprising:

a housing defining a chamber; and a first pouch containing smokable material, wherein:

the first pouch is located within the chamber and attached to the chamber, at least part of the first pouch is made of porous material for permitting aerosol or volatilized material generated within the first pouch to pass out of the first pouch from within the first pouch, the first pouch defines part of an exterior surface of the cartridge, the exterior surface of the cartridge comprises a cavity for receiving in use a heating device for heating the smokable material, and the first pouch defines at least part of the cavity, wherein the cartridge comprises a second pouch that contains smokable material and defines a second part of the cavity, and wherein at least part of the second pouch is made of porous material for permitting aerosol or volatilized material generated within the second pouch to pass out of the second pouch from within the second pouch.

2. A cartridge according to claim 1, wherein the first pouch and the second pouch define opposite sides of the cavity.

3. A cartridge according to claim 1, wherein at least one of the first pouch and the second pouch comprises a first wall made of a first material and a second wall made of a second material that is a different material to the first material, and wherein the smokable material is arranged between the first wall and the second wall.

4. A cartridge according to claim 3, wherein the second wall is porous for permitting aerosol or volatilized material generated within at least one pouch selected from the group consisting of the first pouch and the second pouch to pass out of the selected first pouch or second pouch from within the selected first pouch or second pouch, and the first wall is less porous to the aerosol or volatilized material than the second wall.

5. A cartridge according to claim 1, wherein at least one of the first pouch and the second pouch is attached to the housing.

6. A cartridge according to claim 1, comprising a mass of aerosol containment material within the chamber.

7. A cartridge according to claim 6, wherein the aerosol containment material comprises one or more materials selected from the group consisting of: wadding, fleece, non-woven material, non-woven fleece, woven material, knitted material, nylon, foam, polystyrene, polyester, polyester filament, polypropylene, and a blend of polyester and polypropylene.

8. A cartridge according to claim 1, wherein at least part of at least one of the first pouch and the second pouch comprises one or more materials selected from the group consisting of: fleece, viscose, non-woven material, non-woven fleece, woven material, knitted material, nylon, and polyester.

9. A cartridge according to claim 1, wherein the smokable material comprises tobacco.

10. A cartridge according to claim 1, wherein the smokable material comprises an aerosol forming agent.

* * * * *